US009222058B2

(12) United States Patent
Lock et al.

(10) Patent No.: US 9,222,058 B2
(45) Date of Patent: Dec. 29, 2015

(54) CLEANING COMPOSITION AND METHOD FOR REMOVAL OF SUNSCREEN STAINS

(71) Applicant: Ecolab USA Inc., St. Paul, MN (US)

(72) Inventors: Dawn N. Lock, Inver Grove Heights, MN (US); Stephan M. Hubig, Maplewood, MN (US); Kim R. Smith, Woodbury, MN (US); Joshua A. Ackerman, Rosemount, MN (US)

(73) Assignee: ECOLAB USA INC., St. Paul, MN (US)

( * ) Notice: Subject to any disclaimer, the term of this patent is extended or adjusted under 35 U.S.C. 154(b) by 145 days.

(21) Appl. No.: 13/797,082

(22) Filed: Mar. 12, 2013

(65) Prior Publication Data

US 2014/0259440 A1 Sep. 18, 2014

(51) Int. Cl.

| | |
|---|---|
| ***C11D 1/75*** | (2006.01) |
| ***C11D 3/20*** | (2006.01) |
| ***C11D 3/30*** | (2006.01) |
| ***C11D 3/43*** | (2006.01) |
| ***C11D 3/44*** | (2006.01) |
| ***C11D 1/72*** | (2006.01) |
| ***C11D 3/04*** | (2006.01) |
| ***C11D 3/34*** | (2006.01) |

(52) U.S. Cl.

CPC .. *C11D 1/75* (2013.01); *C11D 1/72* (2013.01); *C11D 3/042* (2013.01); *C11D 3/2041* (2013.01); *C11D 3/2068* (2013.01); *C11D 3/2075* (2013.01); *C11D 3/2079* (2013.01); *C11D 3/2082* (2013.01); *C11D 3/30* (2013.01); *C11D 3/349* (2013.01); *C11D 3/43* (2013.01)

(58) Field of Classification Search

CPC ..... C11D 1/72; C11D 1/75; C11D 3/2041; C11D 3/3068; C11D 3/2075; C11D 3/2079; C11D 3/2082; C11D 3/30; C11D 11/0017

USPC ..... 510/336, 337, 350, 361, 477, 488, 499, 510/505, 506; 8/137

See application file for complete search history.

(56) References Cited

U.S. PATENT DOCUMENTS

| | | | | |
|---|---|---|---|---|
| 3,871,898 A | | 3/1975 | Reinert et al. | |
| 4,492,646 A | | 1/1985 | Welch | |
| 5,082,584 A | * | 1/1992 | Loth | C11D 17/0021 510/101 |
| 5,376,310 A | * | 12/1994 | Cripe | C11D 17/003 510/108 |
| 5,393,468 A | | 2/1995 | Erilli et al. | |

(Continued)

FOREIGN PATENT DOCUMENTS

| | | |
|---|---|---|
| EP | 0368146 A2 | 5/1990 |
| EP | 0573341 B1 | 7/1998 |

(Continued)

OTHER PUBLICATIONS

International Search Report, PCT/US2010/049319, mailed Jun. 1, 2011.
International Search Report, PCT/US2010/049326, mailed Jun. 1, 2011.
International Search Report, PCT/US2010/049334, mailed Jun. 21, 2011.
International Search Report, PCT/US2010/049338, mailed Jun. 28, 2011.

(Continued)

*Primary Examiner* — Gregory R Delcotto
(74) *Attorney, Agent, or Firm* — Amy J. Hoffman

(57) ABSTRACT

The invention is directed to a cleaning composition and method for reducing yellow stains caused by sunscreen components such as avobenzone, oxybenzone, homosalate, octinoxate, octisalate, octocrylene or combinations thereof. The cleaning composition employs a synergistic combination of an amine oxide/solvent and a souring agent.

17 Claims, 8 Drawing Sheets

(56) References Cited

U.S. PATENT DOCUMENTS

| | | | | |
|---|---|---|---|---|
| 5,500,153 | A * | 3/1996 | Figueroa | C11D 3/0094 510/292 |
| 5,597,507 | A | 1/1997 | Garrett et al. | |
| 5,688,930 | A | 11/1997 | Bertho et al. | |
| 5,707,948 | A | 1/1998 | Evers et al. | |
| 5,888,957 | A | 3/1999 | Durbut et al. | |
| 5,994,283 | A | 11/1999 | Durbut et al. | |
| 6,136,769 | A | 10/2000 | Asano et al. | |
| 6,156,712 | A | 12/2000 | Stringer et al. | |
| 6,221,823 | B1 * | 4/2001 | Crisanti et al. | 510/238 |
| 6,228,829 | B1 | 5/2001 | Vinson et al. | |
| 6,274,874 | B1 | 8/2001 | Sidhu | |
| 6,277,808 | B1 | 8/2001 | Tcheou et al. | |
| 6,472,364 | B1 | 10/2002 | Heltovics | |
| 6,511,954 | B1 | 1/2003 | Wilbur et al. | |
| 6,589,926 | B1 | 7/2003 | Vinson et al. | |
| 6,613,726 | B1 | 9/2003 | Gagliardi et al. | |
| 6,667,289 | B2 * | 12/2003 | Harrison et al. | 510/384 |
| 6,740,627 | B1 | 5/2004 | Clarke et al. | |
| 6,786,223 | B2 * | 9/2004 | Klinkhammer et al. | 134/25.2 |
| 6,827,795 | B1 | 12/2004 | Kasturi et al. | |
| 7,037,884 | B2 | 5/2006 | Man | |
| 7,467,633 | B2 | 12/2008 | Smith et al. | |
| 8,136,274 | B2 * | 3/2012 | Sunder et al. | 38/144 |
| 8,338,358 | B2 * | 12/2012 | Bernhardt | C07C 303/06 510/495 |
| 2001/0026942 | A1 | 10/2001 | Carpenter et al. | |
| 2002/0032241 | A1 * | 3/2002 | Schnyder et al. | 514/717 |
| 2002/0082178 | A1 * | 6/2002 | Besse et al. | 510/197 |
| 2002/0103098 | A1 * | 8/2002 | Harrison et al. | 510/382 |
| 2002/0193268 | A1 | 12/2002 | Embleton et al. | |
| 2003/0139313 | A1 | 7/2003 | Turner et al. | |
| 2003/0158066 | A1 * | 8/2003 | Ryan et al. | 510/270 |
| 2004/0186037 | A1 * | 9/2004 | Cheung et al. | 510/426 |
| 2005/0215449 | A1 * | 9/2005 | Penninger et al. | 510/267 |
| 2005/0239674 | A1 * | 10/2005 | Dreja et al. | 510/180 |
| 2006/0035807 | A1 * | 2/2006 | Kasturi | A61K 8/44 510/475 |
| 2006/0070189 | A1 * | 4/2006 | Raehse et al. | 8/115.51 |
| 2006/0128585 | A1 * | 6/2006 | Adair | C11D 1/62 510/383 |
| 2006/0211593 | A1 | 9/2006 | Smith et al. | |
| 2007/0099816 | A1 * | 5/2007 | Scheuing et al. | 510/475 |
| 2007/0111924 | A1 * | 5/2007 | Ford | 510/499 |
| 2007/0143032 | A1 | 6/2007 | Wieringa et al. | |
| 2007/0185004 | A1 * | 8/2007 | Kilkenny | C11D 1/62 510/475 |
| 2008/0051309 | A1 * | 2/2008 | Lin | C11D 3/373 510/341 |
| 2008/0188392 | A1 * | 8/2008 | Diamond | C11D 3/188 510/309 |
| 2008/0207981 | A1 | 8/2008 | Hoag et al. | |
| 2009/0124528 | A1 * | 5/2009 | Danziger | C11D 3/3723 510/224 |
| 2009/0183877 | A1 | 7/2009 | Quintero et al. | |
| 2009/0197786 | A1 * | 8/2009 | Perry et al. | 510/191 |
| 2009/0197792 | A1 * | 8/2009 | Sengupta et al. | 510/418 |
| 2009/0197793 | A1 * | 8/2009 | Inoue et al. | 510/433 |
| 2009/0208051 | A1 | 8/2009 | Emo et al. | |
| 2009/0223635 | A1 | 9/2009 | Lawless | |
| 2009/0261270 | A1 | 10/2009 | Carling | |
| 2010/0093591 | A1 * | 4/2010 | Lant | 510/320 |
| 2011/0092407 | A1 * | 4/2011 | Murphy et al. | 510/218 |
| 2011/0160116 | A1 * | 6/2011 | Mckechnie | C11D 1/66 510/362 |
| 2011/0237486 | A1 * | 9/2011 | Souter | C11D 3/38627 510/321 |
| 2011/0257062 | A1 * | 10/2011 | Dykstra | C11D 3/30 510/303 |
| 2013/0139327 | A1 * | 6/2013 | Sieben et al. | 8/137 |

FOREIGN PATENT DOCUMENTS

| | | | |
|---|---|---|---|
| JP | 63073140 | A | 4/1988 |
| JP | 1100442 | A | 4/1989 |
| JP | 10292199 | A | 11/1998 |
| JP | 2001246339 | | 9/2001 |
| JP | 2009210514 | | 9/2009 |
| WO | 9732962 | | 9/1997 |
| WO | 9927054 | | 6/1999 |
| WO | 0068348 | | 11/2000 |
| WO | 2007064525 | A1 | 6/2007 |
| WO | 2007101470 | A1 | 9/2007 |
| WO | 2010086821 | A2 | 8/2010 |

OTHER PUBLICATIONS

Barber, J.A.S., et al., "Fluorescent tracer technique for measuring the quantity of pesticide deposited to soil following spray applications," ELSEVIER, Crop Protection 22 (2003) pp. 15-21.

Bergervoet, P.W.M., et al., "Application of the forensic Luminol for blood in infection control," ELSEVIER, Journal of Hospital Infection (2008) 68, pp. 329-333.

Carling, Philip C., et al., "Improved Cleaning of Patient Rooms Using a New Targeting Method," Brief Report, CID 2006:42 (Feb. 1), pp. 385-388.

Charoensaeng, Ampira, et al, "Solubilization and Adsolubilization of Polar and Nonpolar Organic Solutes by Linker Molecules and Extended Surfactants," Springer AOCS, J. Surfact. Deterg. (2009) 12, pp. 209-217.

Do, Linh D., et al., "Environmentally Friendly Vegetable Oil Microemulsions Using Extended Surfactants and Linkers," Springer AOCS, J. Surfact. Deterg. (2009) 12, pp. 91-99.

Griffith, C.J., et al. "An evaluation of hospital cleaning regimes and standards," The Hospital Infection Society, Journal of Hospital Infection (2000) 45, pp. 19-28.

Hartel, Peter G., et al., "Exposing water samples to ultraviolet light improves fluorometry for detecting human fecal contamination," ELSEVIER, Water Research (2007) pp. 3629-3642.

Lipscomb, I.P., et al., "Rapid method for the sensitive detection of protein contamination on surgical instruments," ELSEVIER, Journal of Hospital Infection (2006) 62, pp. 141-148.

Lu, Y.F., et al., "Laser surface cleaning and real-time monitoring," ALT '99 International Conference on Advanced Laser Technologies, SPIE vol. 4070 (2000), pp. 331-337.

Mori, F., et al., "Equilibrium and dynamic behavior of a system containing a mixture of anionic and nonionic surfactants," Progress in Colloid & Polymer Science (1990) 82, pp. 114-121.

Phan, Tri T., et al., "Microemulsion-Based Vegetable Oil Detergency Using an Extended Surfactant," Springer AOCS, J. Surfact. Deterg (2010) 13, pp. 313-319.

Pyrek, Kelly M., "Hospitals Can Learn from CSI Sleuthing Methods," Virgo Publishing (2011), posted on Jun. 9, 2008 at website: http://www.infectioncontroltoday.com/.

Salo, Satu, et al., "Cleaning validation of fermentation tanks," ELSEVIER, Food and Bioproducts Processing 86 (2008) pp. 204-210.

Wisniewski, Karen, "Specialty Liquid Household Surface Cleaners," Research & Development, Global Technology, Colgate-Palmolive Company, pp. 463-512.

Witthayapanyanon, Anuradee, et al., "Interfacial Properties of Extended-Surfactant-Based Microemulsions and Related Macroemulsions," Springer AOCS, J. Surfact. Deterg. (2010) 13, pp. 127-134.

Zhang, Hui, et al., "Lauryl Alcohol and Amine Oxide as Foam Stabilizers in the Presence of Hardness and Oily Soil," Journal of Surfactants and Detergents, vol. 8, No. 1 (Jan. 2005), pp. 99-107.

Website of "Cleanser alcohol hand rub training gel Fluroescent gel 500ml bottle with integral pump dispenser," [retrieved on Mar. 25, 2011], retrieved from the internet: https://my.supplychain.nhs.uk/catalogue/product/mrb180/cleanser-alcohol-hand-rub-training-gel.

* cited by examiner

CLEANING COMPOSITION AND METHOD FOR REMOVAL OF SUNSCREEN STAINS

FIELD OF THE INVENTION

The invention is directed to a cleaning composition and method for reducing yellow stains caused by sunscreen components such as avobenzone, oxybenzone, homosalate, octinoxate, octisalate, octocrylene or combinations thereof. The cleaning composition employs a synergistic combination of an amine oxide/solvent and a souring agent.

BACKGROUND

Consumers have drastically increased use of sunscreens in light of recommendations by medical organizations such as the American Cancer Society. Sunscreen can prevent the squamous cell carcinoma and the basal cell carcinoma which may be caused by ultraviolet radiation from the sun. Many of these sunscreens contain components such as avobenzone, oxybenzone, homosalate, octinoxate, octisalate, octocrylene or combinations thereof. These sunscreen components are often deposited onto linens, such as towels and sheets, in resort and spa facilities and such. These chemicals, while not visible prior to wash, typically appear on fabrics as yellow patches after washing with detergent-builder combinations at high pH. Current methods to treat these types of stains have included bleach, and other traditional pretreatments, to no avail.

As can be seen, there is a need in the industry for improvement of cleaning compositions so that difficult sunscreen stains can be removed from fabrics in a safe environmentally friendly and effective manner.

Other objects, aspects and advantages of this invention will be apparent to one skilled in the art in view of the following disclosure, the drawings, and the appended claims.

SUMMARY OF THE INVENTION

Figure 1:
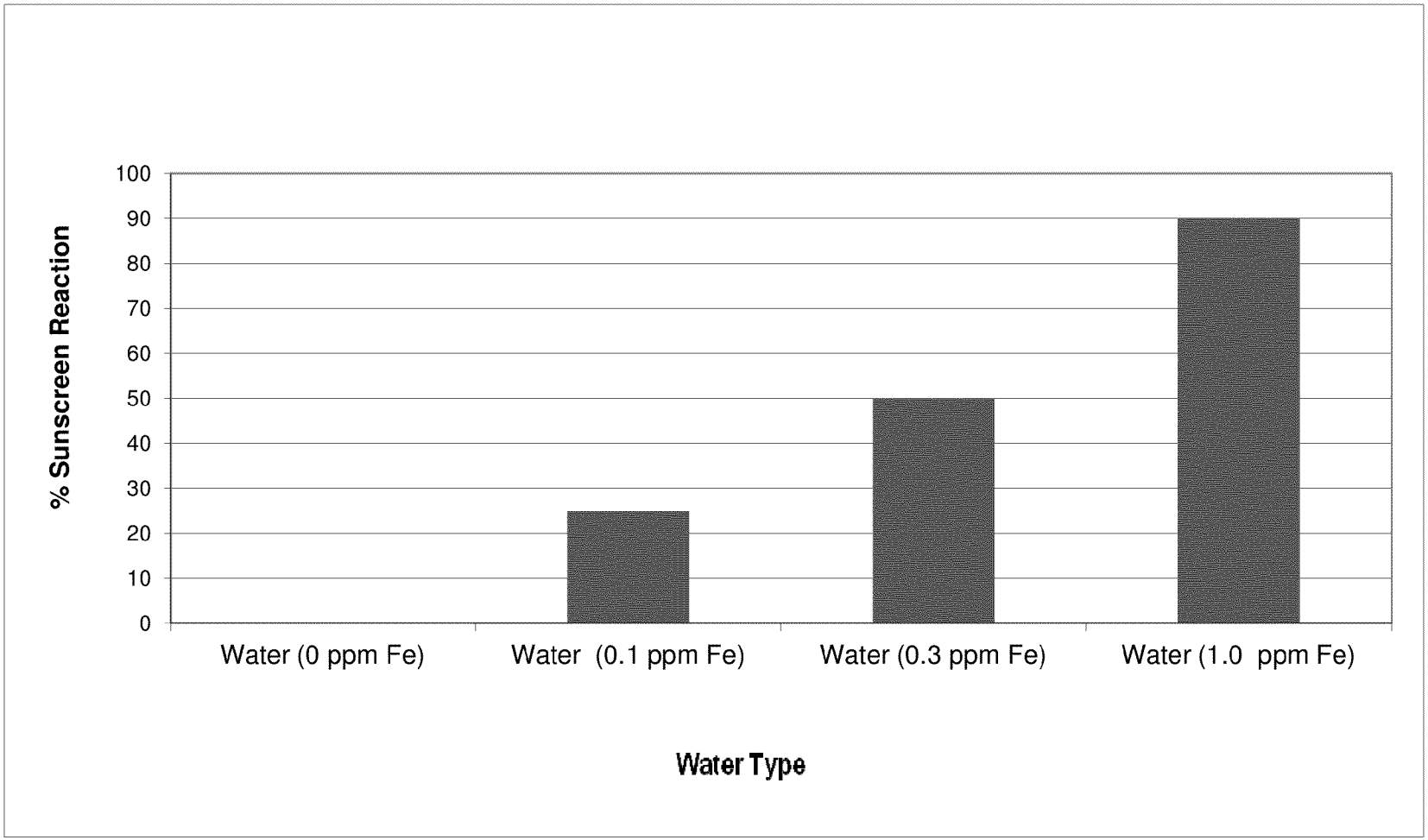
FIG. 1 is a bar graph illustrating the percentage of yellow staining remaining on terry swatches after being rinsed with water containing varying levels of iron.

The summary of the invention is intended to introduce the reader to various exemplary aspects of the invention. Particular aspects of the invention are shown in other sections herein below, and the invention is set forth in the appended claims which alone demarcate its scope.

In accordance with an exemplary embodiment of the present invention, a cleaning composition for reducing yellow stains caused by sunscreen components which result in sunscreen stains on an article is provided. The cleaning composition comprises a souring agent, an amine oxide/solvent mixture and water.

Accordingly, one aspect of the present invention is to provide a cleaning composition for reducing yellow stains caused by sunscreen components which results in sunscreen stains on an article comprising: (a) a souring agent, an amine oxide/solvent mixture at a 1:1 to a 1:1.5 ratio and water.

According to a further aspect of the invention there is provided a method for laundering an article that is contacted with sunscreen components, the method comprising: (a) providing an article that has been contacted with a sunscreen component; (b) washing the article; (c) rinsing the article; (d) drying the article; and (e) treating the article with a souring agent and an amine oxide/solvent mixture, during or prior to or after the article is laundered in the washing step.

While multiple embodiments are disclosed, still other embodiments of the present invention will become apparent to those skilled in the art from the following detailed description, which shows and describes illustrative embodiments of the invention. Accordingly, the detailed description is to be regarded as illustrative in nature and not restrictive.

DETAILED DESCRIPTION OF THE PREFERRED EMBODIMENTS

So that the invention may be more readily understood, certain terms are first defined and certain test methods are described.

It should be noted that, as used in this specification and the appended claims, the singular forms "a," "an," and "the" include plural referents unless the content clearly dictates otherwise. Thus, for example, reference to a composition containing "a compound" includes a composition having two or more compounds. It should also be noted that the term "or" is generally employed in its sense including "and/or" unless the content clearly dictates otherwise.

As used herein, "weight percent," "wt-%," "percent by weight," "% by weight," and variations thereof refer to the concentration of a substance as the weight of that substance divided by the total weight of the composition and multiplied by 100. It is understood that, as used here, "percent," "%," and the like are intended to be synonymous with "weight percent," "wt-%," etc.

The term "about," as used herein, modifying the quantity of an ingredient in the compositions of the invention or employed in the methods of the invention refers to variation in the numerical quantity that can occur, for example, through typical measuring and liquid handling procedures used for making concentrates or use solutions; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about," the claims include equivalents to the quantities. All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

The term "cleaning" refers to performing or aiding in soil removal, bleaching, rinsing, or combination thereof.

As used herein, the term "soil" or "stain" refers to a non-polar oily substance which may or may not contain particulate matter such as mineral clays, sand, natural mineral matter, carbon black, graphite, kaolin, environmental dust, etc.

As used herein, the term "cleaning composition" includes, unless otherwise indicated, detergent compositions, laundry cleaning composition and the like. Cleaning compositions include granular, powder, liquid, gel, paste, bar form and/or flake type cleaning agents, laundry detergent cleaning agents, laundry soak or spray treatments, fabric treatment compositions, and other similar cleaning compositions. As used herein, the term "fabric treatment composition" includes, unless otherwise indicated, fabric softening compositions, fabric enhancing compositions, fabric freshening compositions and combinations there of. Such compositions may be, but need not be rinse added compositions.

As used herein, the term "laundry" refers to items or articles that are cleaned in a laundry washing machine. In general, laundry refers to any item or article made from or including textile materials, woven fabrics, non-woven fabrics, and knitted fabrics. The textile materials can include natural or synthetic fibers such as silk fibers, linen fibers, cotton fibers, polyester fibers, polyamide fibers such as nylon, acrylic fibers, acetate fibers, and blends thereof including cotton and polyester blends. The fibers can be treated or untreated.

As used herein, the term "linen" is often used to describe certain types of laundry items including bed sheets, pillow cases, towels, table linen, table cloth, bar mops and uniforms.

Cleaning Composition for Removal of Sunscreen Stains

There have been increasing reports of yellow stains on linen that are believed to be caused by sunscreen formulations. These stains are not visible prior to the wash, but typically appear on the linen (usually cotton towels) as yellow patches after washing with detergent-builder combinations at high pH, especially when using chlorine bleach. In other words, the stains are "set" by alkali and chlorine bleach. If the water quality is poor and high levels of iron are present the yellow spots can even become orange in color.

Attempts in the field to remove these stains using normal combinations of detergents, detergency boosters, and bleach have not been successful. It has been reported that using mild neutral detergent with oxygen bleach does not tend to form the stains, but this combination also does not offer the level of cleaning performance desired.

These sunscreen formulations contain a variety of active ingredients, but the ones of most concern are the polyphenyl aromatics avobenzone, oxybenzone, homosalate, octinoxate, octisalate, octocrylene or combinations thereof. Formulations with higher Sun Protective Factors (SPFs) contain more of these actives, and form more severe yellow stains. Whereas, formulations that lack these actives do not tend to form yellow stains. These structures have active (acidic) hydrogen which helps to explain the effect of the alkali, which is believed to react with the actives that are highly colored. It can also explain the effect of the final sour, in that the acid protonates the colored salts to regenerate the less colored acid forms.

It has been found that iron rich water leads to even more highly colored stains from the sunscreens. The sunscreen actives combine with the iron in the water to form highly colored complexes. The structure of Avobenzone, which contains a 1,3-diketone moiety is known to form strong metal complexes. Applicants have found that it is possible to lessen or remove the yellow stains caused by sunscreen by a synergistic combination of a souring agent and an amine oxide/solvent system added to the laundry process.

The cleaning composition according to the present invention includes (a) a souring agent (b) an amine oxide/solvent mixture at a 1:1 to 1:1.5 ratio and (c) water.

According to a further aspect of the invention there is provided a method for laundering an article that is contacted with sunscreen components, the method comprising: (a) providing an article that has been contacted with a sunscreen component; (b) washing the article; (c) rinsing the article; (d) drying the article; and (e) treating the article with a souring agent and an amine oxide/solvent mixture, during or prior to or after the article is laundered in the washing step.

Souring Agent

The cleaning composition of the present invention may be used alone, as a pre-spot or pre-treatment composition in combination with a traditional detergent or cleaner, or may be incorporated within a cleaning composition. The cleaning composition can provide clean, sanitized and neutralized laundry items, the process including contacting soiled laundry items containing sunscreen stains with an alkaline detergent to form a treated laundry item, and contacting the laundry item with a souring agent and an amine oxide/solvent mixture, wherein the cleaning composition is capable of cleaning and neutralizing the laundry item.

Exemplary and preferred souring agents which may be used in the composition include phosphoric acid, citric acid, hexafluorosilicic acid, gluconic acid, tartaric acid, acetic acid, oxalic acid, methane sulfonic acid, urea sulfate or combinations thereof. Such materials are widely commercially available.

The amount of souring agent in the composition is related to the end use of the composition, the amount of amine oxide/solvent and water in the composition and the presence of optional ingredients in the composition. The amount of souring agent is sufficient to neutralize the laundry item.

Amine Oxide/Solvent System

The cleaning composition can contain an amine oxide which is an amphoteric surfactant component. Amine oxides can be included in the cleaning composition to enhance sunscreen removal properties.

Additional amphoteric surfactants that can be used in the composition in replacement of amine oxide include cocamidopropyl betaine, lauramidopropyl betaine, oleamidopropyl betaine, ricinoleamidopropyl betaine, cetyp betaine dimer dilinoleamidopropyl betaine, imidazolinium betaine, dodecyl betaine, cocoamido-2-hydroxypropyl sulfobetaine, disodium lauramphoacetate, coco amino proprionate, lauryl imino diproprionate, cocoimino mono/diproprionate, coco amphoacetate, alkylamphoproprionates, sulfobetaines, hydroxyl sulfobetaines, sultaines and other similar compounds.

Solvents useful for the present invention include polyethylene oxide ethers derived from lauryl alcohol, cetyl alcohol, oleyl alcohol, stearyl alcohol, isostearyl alcohol, myristyl alcohol, behenyl alcohol, and mixtures thereof. In addition, polyoxyethylene 10 cetyl ether, known by the CTFA designation as ceteth-10; polyoxyethylene stearyl ether, known by the CTFA designation steareth-21; coconut alkyl polyethoxylate; decyl polyethoxylate, ethoxylates of nonylphenol, dinonylphenol, dodecylphenol, dodecyl alcohol or sorbitan lauryl esters ethoxylated with 20 EO groups and mixtures thereof may also be used. Particularly preferred are butyl carbitol and/or propylene-glycol-phenyl-ether.

Suitable solvents include water and other solvents such as lipophilic fluids. Examples of suitable lipophilic fluids include siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, other environmentally-friendly solvents and mixtures thereof. In some embodiments, the solvent includes water. The water can include water from any source including deionized water, tap water, softened water, and combinations thereof.

The amount of amine oxide/solvent in the composition is related to the end use of the composition, the amount of souring agent and water in the composition and the presence of optional ingredients in the composition. The amount of amine oxide/solvent is sufficient to remove grease and sunscreen stains from the laundry item.

Optical Brightener

In some embodiments, an optical brightener component, may be present in the compositions of the present invention. The optical brightener can include any brightener that is capable of eliminating graying and yellowing of fabrics. Typically, these substances attach to the fibers and bring about a brightening and simulated bleaching action by converting invisible ultraviolet radiation into visible longer-wave length light, the ultraviolet light absorbed from sunlight being irradiated as a pale bluish fluorescence and, together with the yellow shade of the grayed or yellowed laundry, producing pure white.

Fluorescent compounds belonging to the optical brightener family are typically aromatic or aromatic heterocyclic materials often containing condensed ring systems. An important feature of these compounds is the presence of an uninterrupted chain of conjugated double bonds associated with an aromatic ring. The number of such conjugated double bonds is dependent on substituents as well as the planarity of the fluorescent part of the molecule. Most brightener compounds are derivatives of stilbene or 4,4'-diamino stilbene, biphenyl, five membered heterocycles (triazoles, oxazoles, imidazoles, etc.) or six membered heterocycles (cumarins, naphthalamides, triazines, etc.).

Optical brighteners useful in the present invention are known and commercially available. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles and other miscellaneous agents. Examples of these types of brighteners are disclosed in "The Production and Application of Fluorescent Brightening Agents", M. Zahradnik, Published by John Wiley & Sons, New York (1982), the disclosure of which is incorporated herein by reference.

Stilbene derivatives which may be useful in the present invention include, but are not necessarily limited to, derivatives of bis(triazinyl)amino-stilbene; bisacylamino derivatives of stilbene; triazole derivatives of stilbene; oxadiazole derivatives of stilbene; oxazole derivatives of stilbene; and styryl derivatives of stilbene. In an embodiment, optical brighteners include stilbene derivatives.

In some embodiments, the optical brightener includes Tinopal UNPA, which is commercially available through the Ciba Geigy Corporation located in Switzerland.

Additional optical brighteners for use in the present invention include, but are not limited to, the classes of substance of 4,4'-diamino-2,2'-stilbenedisulfonic acids (flavonic acids), 4,4'-distyrylbiphenyls, methylumbelliferones, coumarins, dihydroquinolinones, 1,3-diarylpyrazolines, naphthalimides, benzoxazol, benzisoxazol and benzimidazol systems, and pyrene derivatives substituted by heterocycles, and the like. Suitable optical brightener levels include lower levels of from about 0.01, from about 0.05, from about 0.1 or even from about 0.2 wt % to upper levels of 0.5 or even 0.75 wt %.

Form of the Cleaning Composition

The cleaning compositions of the present invention may be of any suitable form, including paste, liquid, solid (such as tablets, powder/granules), foam or gel, with powders and tablets being preferred. The composition may be in the form of a unit dose product, i.e. a form which is designed to be used as a single portion of detergent composition in a washing operation. Of course, one or more of such single portions may be used in a cleaning operation.

Solid forms include, for example, in the form of a tablet, rod, ball or lozenge. The composition may be a particulate form, loose or pressed to shape or may be formed by injection moulding or by casting or by extrusion. The composition may be encased in a water soluble wrapping, for, example of PVOH or a cellulosic material. The solid product may be provided as a portioned product as desired.

The composition may also be in paste, gel or liquid form, including unit dose (portioned products) products. Examples include a paste, gel or liquid product at least partially surrounded by, and preferably substantially enclosed in a water-soluble coating, such as a polyvinyl alcohol package. This package may for instance take the form of a capsule, a pouch or a moulded casing (such as an injection moulded casing) etc.

Preferably the composition is substantially surrounded by such a package, most preferably totally surrounded by such a package. Any such package may contain one or more product formats as referred to herein and the package may contain one or more compartments as desired, for example two, three or four compartments.

If the composition is a foam, a liquid or a gel it is preferably an aqueous composition although any suitable solvent may be used. According to an especially preferred embodiment of the present invention the composition is in the form of a tablet, most especially a tablet made from compressed particulate material.

If the compositions are in the form of a viscous liquid or gel they preferably have a viscosity of at least 50 mPas when measured with a Brookfield RV Viscometer at 25° C. with Spindle 1 at 30 rpm.

Process of Making the Cleaning Composition

The compositions of the invention may be made by any suitable method depending upon their format. Suitable manufacturing methods for cleaning compositions are well known in the art, non-limiting examples of which are described in U.S. Pat. Nos. 5,879,584; 5,691,297; 5,574,005; 5,569,645; 5,565,422; 5,516,448; 5,489,392; and 5,486,303. Various techniques for forming cleaning compositions in solid forms are also well known in the art, for example, cleaning tablets may be made by compacting granular/particular material and may be used herein.

In one aspect, the cleaning compositions disclosed herein may be prepared by combining the components thereof in any convenient order and by mixing, e.g., agitating, the resulting component combination to form a phase stable liquid detergent composition.

In one aspect, a liquid matrix is formed containing at least a major proportion, or even substantially all, of the liquid components, with the liquid components being thoroughly admixed by imparting shear agitation to this liquid combination. For example, rapid stirring with a mechanical stirrer may usefully be employed. While shear agitation is maintained, substantially all of any anionic surfactant and the solid ingredients can be added. Agitation of the mixture is continued, and if necessary, can be increased at this point to form a solution or a uniform dispersion of insoluble solid phase particulates within the liquid phase.

Method of Using the Cleaning Composition

According to an aspect of the invention there is provided a method for laundering an article that is contacted with sunscreen components, the method comprising: (a) providing an article that has been contacted with a sunscreen component; (b) washing the article; (c) rinsing the article; (d) drying the article; and (e) treating the article with a souring agent and an amine oxide/solvent mixture, during or prior to or after the article is laundered in the washing step.

The invention has been shown and described herein in what is considered to be the most practical and preferred embodiment. The applicant recognizes, however, that departures may be made therefrom within the scope of the invention and that obvious modifications will occur to a person skilled in the art. The examples which follow are intended for purposes of illustration only and are not intended to limit the scope of the invention. All references cited herein are hereby incorporated in their entirety by reference.

EXAMPLES

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques.

Pre-Spotter Test Procedure

Test swatches with sunscreen stains were cut into 2" by 3" swatches from various towels and sheets received from the industry such as hotels, spas, resorts and the like. The test swatches were then secured to a blue pillowcase. The pre-spotter of 50% lauryldimethylamine oxide and 50% diethylene glycol ethyl ether was applied to each swatch and allowed to sit on the test swatch for 15 minutes. Swatches were then washed in a 35 lb. washer in an acid bath of a pH of about 4-5.5 for 15 minutes to remove stains and were then processed through a standard chlorine bleach cycle to see if the stains reappeared.

Wash Wheel Test Procedure

Test swatches with sunscreen stains were cut into 2" by 3" swatches from various towels and sheets received from the industry such as hotels, spas, resorts and the like. The test swatches were then secured to a blue pillowcase. The test swatches were placed in a 35 lb. washer, the machine was filled and a souring agent was dispensed. The test swatches were washed in a souring agent for 1 minute, and then the test formulation was supplied into the washer. The test swatches were washed for 30 minutes and then went through two six minute rinse cycles. The maximum load filled was 25 lbs. in a 35 lb. washer.

Example 1

Yellow Staining in the Presence of Iron

Applicants tested a variety of water types with varying degrees of iron concentration against unwashed sunscreen coated swatches. Five different commercially available sunscreen products were tested, specifically Coppertone Water Babies commercially available from MSD Consumer Care Inc. from Memphis, Tenn., USA (Commercially Available Sunscreen Product A); Aveeno Active Naturals commercially available from Johnson and Johnson, Inc. from New Brunswick, N.J., USA (Commercially Available Sunscreen Product B); Ocean Potion Body Wax commercially available from Ocean Potion, LLC from Cocoa, Fla., USA (Commercially Available Sunscreen Product C); Panama Jack Sunscreen commercially available from Panama Jack from Orlando, Fla., USA (Commercially Available Sunscreen Product D); and, Coral Sunscreen commercially available from Badger Healthy Body Care from Gilsum, N.H., USA (Commercially Available Sunscreen Product E).

Commercially available sunscreen products A-C include avobenzene as an active ingredient, whereas, commercially available sunscreen products D and E do not include avobenzene as an active ingredient and instead use titanium dioxide.

Applicants prepared test samples by coating four 2" by 3" cotton terry swatches with each of the five commercially available sunscreen products, and allowed the swatches to sit overnight. Thereafter twenty 100 mL beakers were filled with water, there were five beakers of each of the four types of water with varying concentrations of iron, specifically water with 0 ppm iron, water with 0.1 ppm iron, water with 0.3 ppm iron and water with 1.0 ppm iron. The prepared sunscreen swatches were then placed in the beakers and heated to 6° C. for one hour. The test swatches were then wrung out and air dried and the yellow stains were ranked by visual inspection from a grade of 0-100% sunscreen reaction.

The results shown in FIG. 1 illustrate that the active ingredient included in sunscreen products, specifically avobenzone, complexes with iron and causes yellow staining on the test swatches. Water with increased iron content causes greater yellow staining from sunscreen products and since distilled water with 0 ppm iron causes no staining, it is evident that iron must be at least one factor causing the yellow staining.

Example 2

Yellow Staining in the Presence of Alkalinity

Applicants tested a variety of commercially available sunscreen products in the presence of an alkalinity source to determine if alkalinity causes yellow staining. Six different commercially available sunscreen products were tested, specifically No AD Sun Lotion commercially available from No-Ad Products, Inc. from Cocoa, Fla., USA (Commercially Available Sunscreen Product F); Aloe Vera After Sun Spray commercially available from Scent Sense Inc. from New York, N.Y., USA (Commercially Available Sunscreen Product G); Neutrogena Ultra Sheer Sunblock commercially available from Neutrogena Corporation, Los Angeles, Calif., USA (Commercially Available Sunscreen Product H); Coppertone Sport Sunscreen from MSD Consumer Care Inc. from Memphis, Tenn., USA (Commercially Available Sunscreen Product I); Suntan Oil commercially available from Scent Sense Inc. from New York, N.Y., USA (Commercially Available Sunscreen Product J); and, Aveeno Active Naturals commercially available from Johnson and Johnson, Inc. from New Brunswick, N.J., USA (Commercially Available Sunscreen Product B).

Included below in Table 1 is the list of active ingredients included in each of the six commercially available sunscreen products:

TABLE 1

| Commercially Available Sunscreen Product Sample | Avobenzone | Homosalate | Octisalate | Octocrylene | Oxybenzone | Octinoxate |
|---|---|---|---|---|---|---|
| F | 2% | 15% | 5% | 0% | 6% | 0% |
| G | 0% | 0% | 0% | 0% | 0% | 0% |
| H | 2% | 7% | 5% | 0% | 3% | 7.5% |
| I | 2% | 10% | 5% | 4% | 5% | 0% |
| J | 0% | 0% | 0% | 0% | 0% | 0% |
| B | 3% | 10% | 5% | 2.8% | 6% | 0% |

Figure 2:
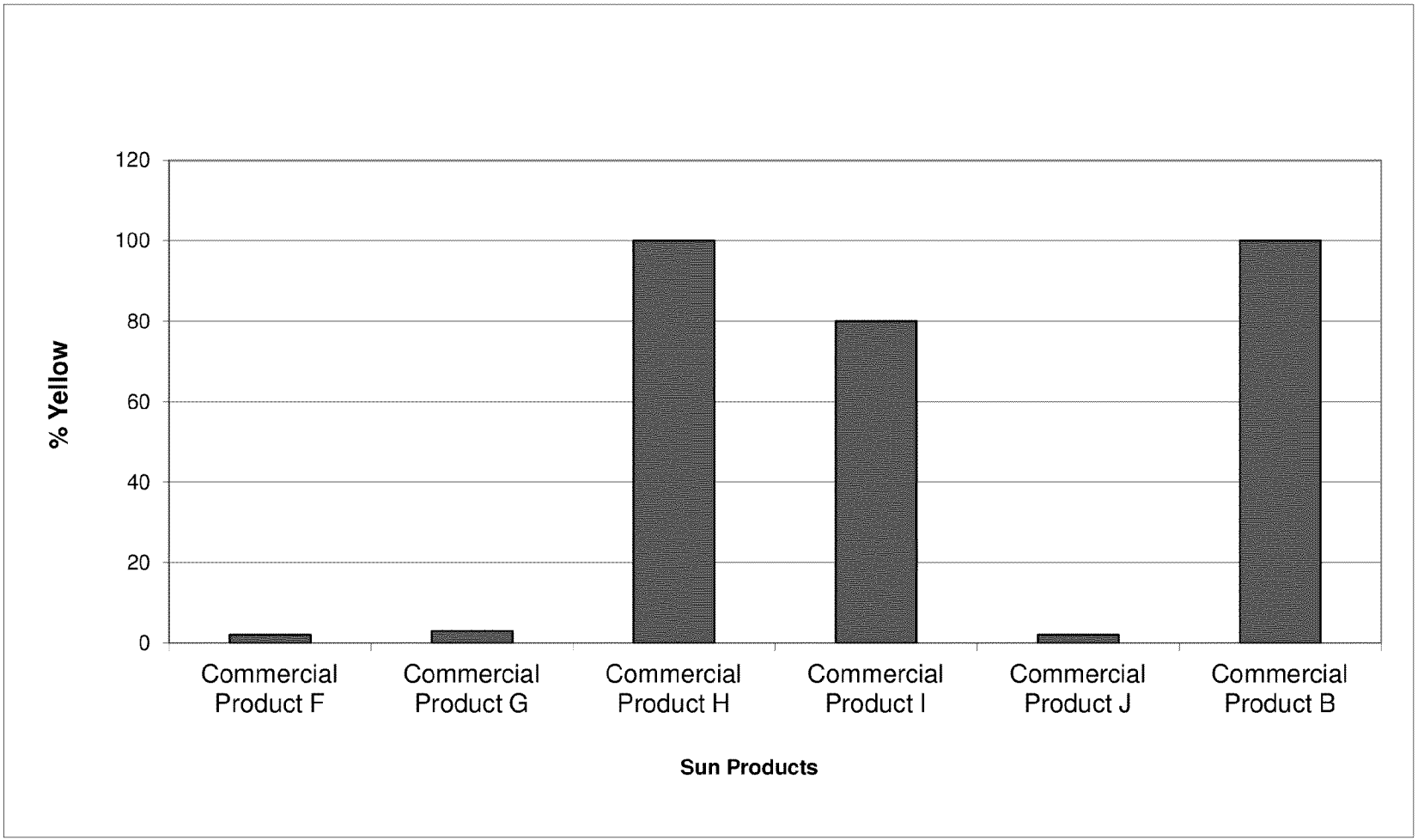
FIG. 2 is a bar graph illustrating the percentage of yellow staining remaining on terry swatches in the presence of an alkali solution.

All six commercially available sunscreen products were applied to a terry swatch and alkali solution was dripped from a pipet onto the sunscreen stained terry swatch. The yellow staining was then ranked by visual inspection. As can be seen in the results illustrated in FIG. 2, commercially available sunscreen products H and B caused the greatest yellow staining in the presence of an alkalinity source. The results illustrate that the active ingredients avobenzone and/or oxybenzone cause the most yellow staining in the presence of an alkalinity source. The results of Example 2 illustrate that an alkalinity source is responsible for causing yellow staining on linens.

Example 3

Removal of Yellow Staining Using a Solvent System as a Pre-Spotter

Applicants tested eight solvent systems, shown below in Table 2, to determine their ability in removing yellow stains caused by sunscreen products. Five commercially available sunscreen products (Commercially Available Sunscreen Products A, B, C, D and E) were applied to terry swatches, and eight swatches of each type were prepared.

Twenty 100 mL beakers were filled with a 5% solution of detergent in the four water types displayed above in Example 1. Twenty other beakers were filled with concentrated detergent, specifically a commercially available detergent, Encompass detergent, which is commercially available by Ecolab Inc. from St. Paul, Minn., USA. The prepared swatches were soaked in the beakers overnight. Afterwards, the swatches were rinsed in hot water and then attached to backers. All of the swatches were washed in a standard chlorine bleach wash cycle. Afterwards Applicants discovered that test swatches created from three of the commercially available sunscreen products turned yellow in the wash cycle, specifically commercially available sunscreen products A, B and C. These stained test swatches were cut in half and then the eight solvents were applied as pre-spotters and were allowed to sit for 15 minutes. The stained test swatches were rinsed in hot water, and removal of the yellow staining was ranked by visual inspection.

TABLE 2

| | |
|---|---|
| Solvent System 1 | Tripropylene glycol methyl ether |
| Solvent System 2 | Oleic Acid |
| Solvent System 3 | Diethylene Glycol Ethyl Ether |
| Solvent System 4 | Ethylan |
| Solvent System 5 | Surfonic |
| Solvent System 6 | Soygold |
| Solvent System 7 | Benzoyl |
| Solvent System 8 | Butyl Cellosolve |

Figure 3:
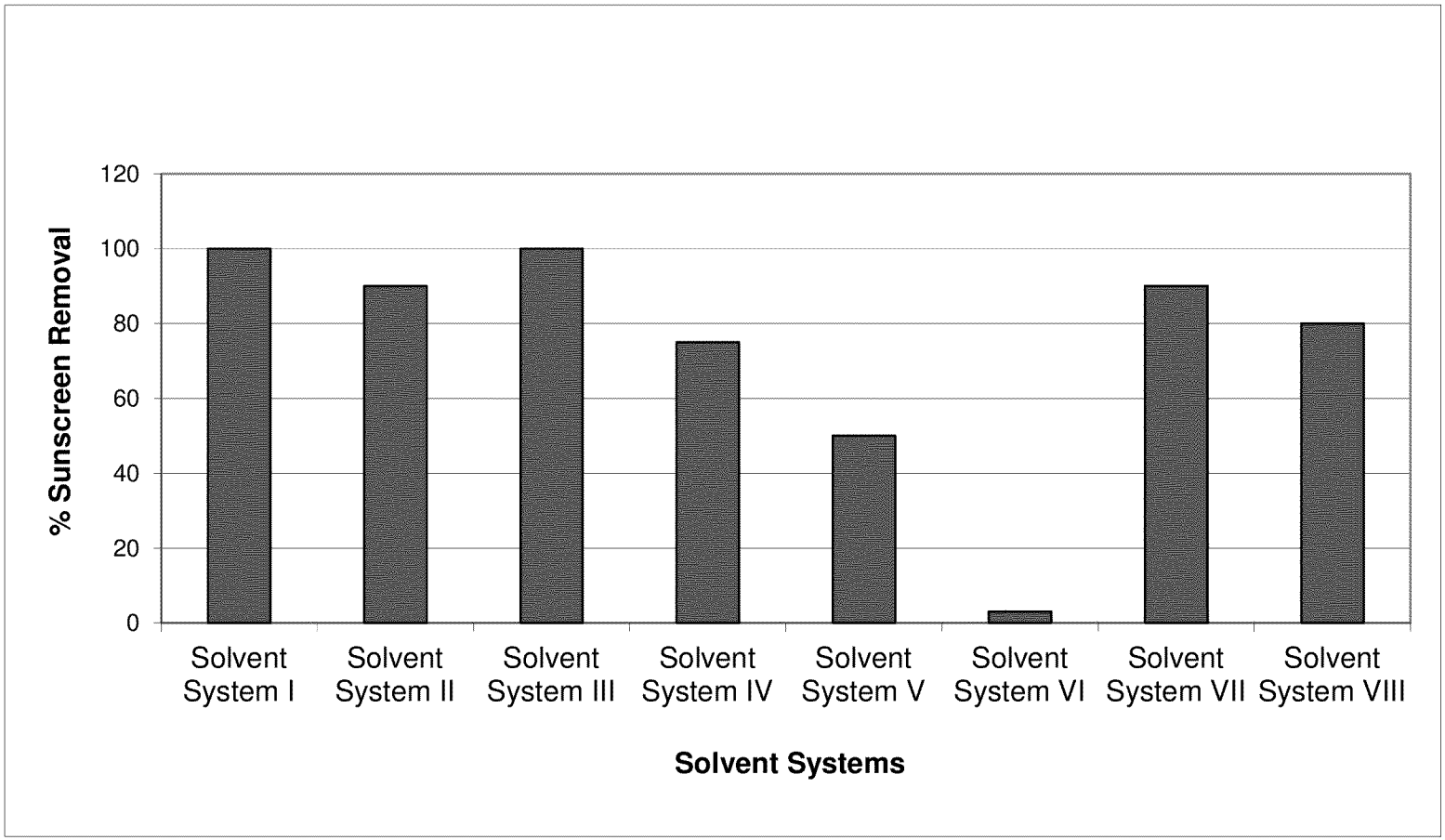
FIG. 3 is a bar graph illustrating the percentage of sunscreen stain removal in the presence of varying solvent systems.

As can be seen in the results illustrated in FIG. 3, Solvent System 1 and Solvent System 3 had the greatest sunscreen removal percentage. The results illustrate that ether based solvents have the best performance for being used as a pre-spotter for removal of yellow stains caused by sunscreen components.

Example 4

Removal of Yellow Staining Using an Amine Oxide Surfactant System in a Sour Solution Applicants received several terry linens with yellow sunscreen stains from external sources such as spas, hotels, resorts and the like. Three stained swatches were cut from these terry linens, and each swatch was pre-spotted with an amine oxide surfactant system. The surfactant systems tested are listed below in table 3. Swatches were then placed in a beaker with 5 grains of acid diluted to 100 mL with deionized water and stirred for 2 minutes. Removal of the yellow stains was then ranked by visual inspection.

TABLE 3

| | |
|---|---|
| Surfactant System 1 | Laurylamine oxide (30% active) |
| Surfactant System 2 | N-Alkyl C14 dimethylamine oxide (30% active) |
| Surfactant System 3 | Dimethylstearylamine oxide (98% active) |

Figure 4:
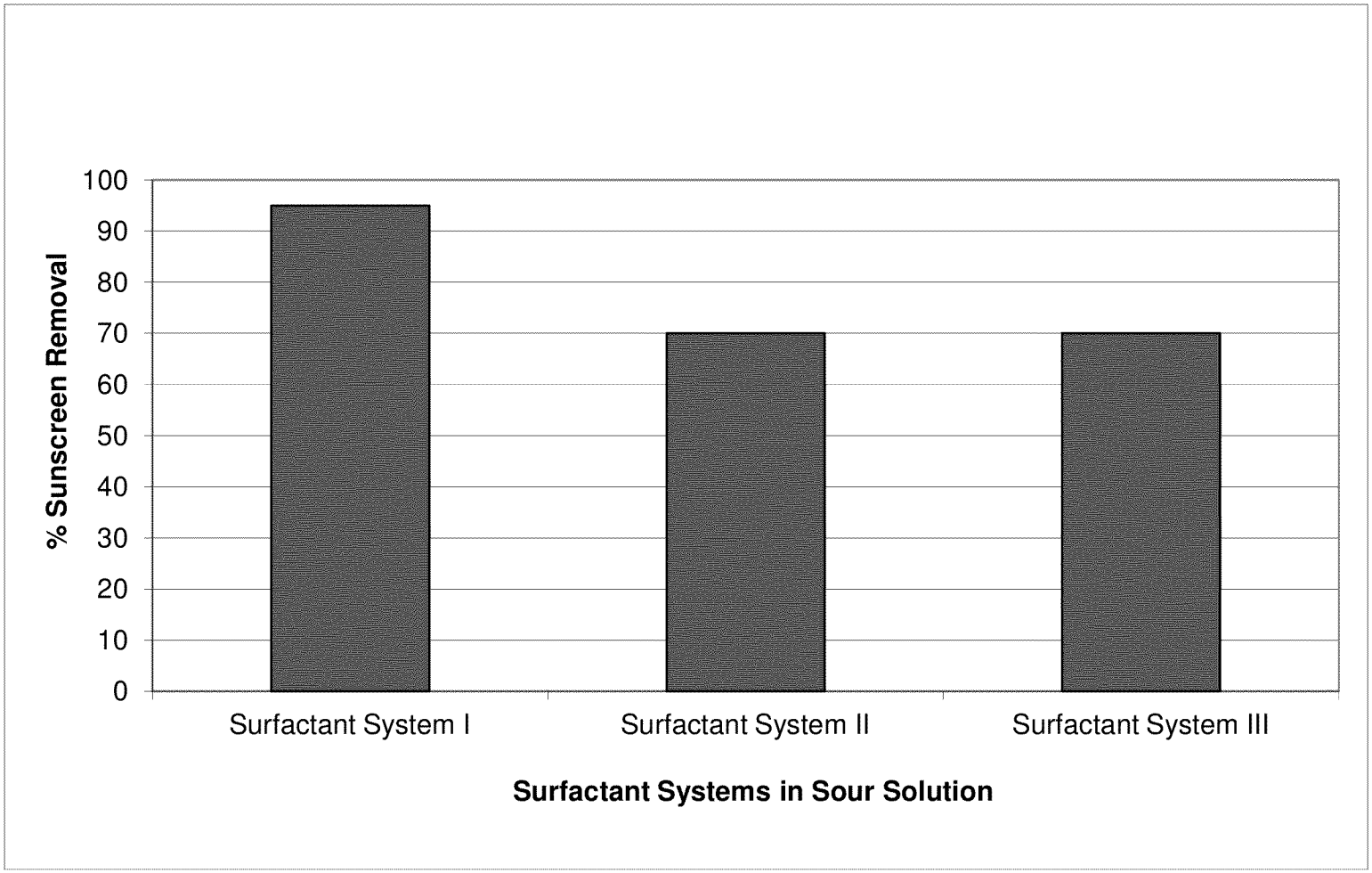
FIG. 4 is a bar graph illustrating the percentage of sunscreen stain removal in the presence of varying levels of amine oxides in a sour solution.

As can be seen in the results illustrated in FIG. 4, Surfactant System 1, specifically laurylamine oxide, had the greatest sunscreen removal percentage. The results illustrate that laurylamine oxide has the best performance as a surfactant system in a sour solution for removal of yellow stains caused by sunscreen components.

Example 5

Removal of Yellow Staining Using Laurylamine Oxide and a Solvent System in a Wash Cycle Applicants received several terry linens with yellow sunscreen stains from external sources such as spas, hotels, resorts and the like. Seven stained swatches were cut from these terry linens, and each swatch was pre-spotted with laurylamine oxide as surfactant system 1 and a solvent system chosen from the list of solvent systems included above in Table 2. Each test swatch was agitated in 1 L of a sour bath, specifically 50 grams of acid (85% hydrofluosilicic acid (HFS) and 15% citric acid) to 1000 mL with deionized water, for 12 minutes. The test swatches were then washed in a standard chlorine wash cycle as stated below in Table 4. Removal of the yellow stains was then ranked by visual inspection.

TABLE 4

| Operation | Time (min) | Temperature (F.) | Level | Product | Amount |
|---|---|---|---|---|---|
| Suds | 7 | Hot | Low | Detergent MP (currently available by Ecolab, Inc. of St. Paul, MN) | 6 oz/cwt |
| Rinse | 1 | Hot | High | | |
| Bleach | 7 | Hot | Low | Destainer (currently available by Ecolab, Inc. of St. Paul, MN) | 100 ppm/cwt |
| Rinse | 2 | Split | High | | |
| Rinse | 2 | Split | High | | |
| Rinse | 2 | Split | High | | |
| Sour/Soft | 4 | Split | Low | Clearly Soft/ Sour Control (currently available by Ecolab, Inc. of St. Paul, MN) | 4 oz (pH 6-7)/ cwt |

Figure 5:
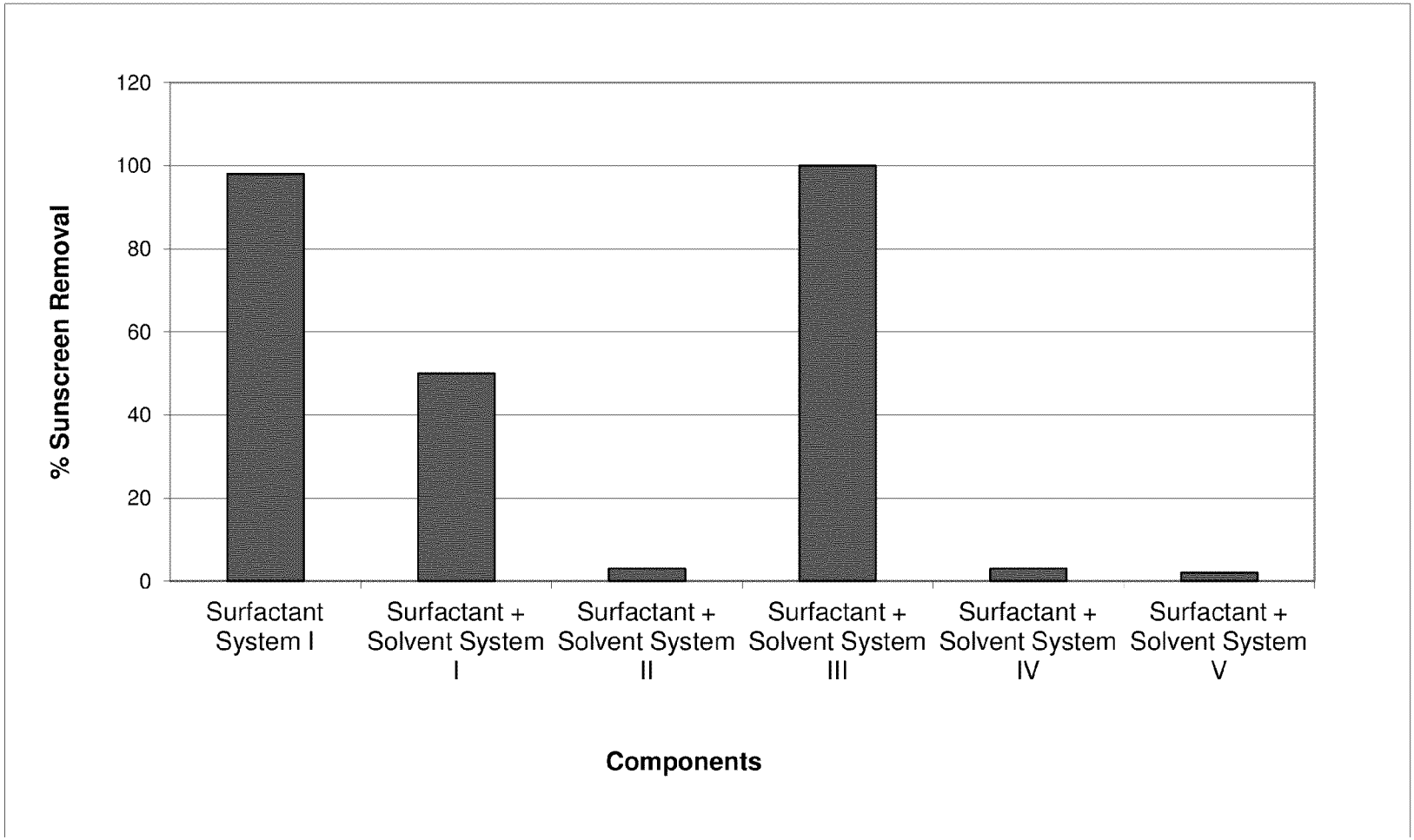
FIG. 5 is a bar graph illustrating the percentage of sunscreen stain removal in the presence of laurylamine oxide with varying solvent systems.

As can be seen in the results illustrated in FIG. 5, Surfactant System 1, specifically laurylamine oxide, alone or combined with Solvent System 3, specifically diethylene glycol ethyl ether had the greatest sunscreen removal percentage. The results illustrate that laurylamine oxide alone or combined with an ether solvent has the best performance for removal of yellow stains caused by sunscreen components.

Example 6

Removal of Yellow Staining Using Laurylamine Oxide/Diethylene Glycol Ethyl Ether Solution (1:1.5 Ratio) in a Sour Bath for a Variety of Linens Applicants received several bath and bed linens with yellow sunscreen stains from external sources such as spas, hotels, resorts and the like. The type of sunscreen products on these linens were unknown. A stained swatch was cut from each of the linen types of a total of 5 test swatches. Each test swatch was washed in a wash wheel cycle with the steps as shown below in Table 5 in which a sour step was added prior to the laurylamine oxide (250 mL)/diethylene glycol ethyl ether (400 mL) solution in a 1:1.5 ratio. The test swatches were washed for 30 minutes followed by three rinse cycles. The test swatches were allowed to dry and then removal of the yellow stains was then ranked by visual inspection.

Figure 6:
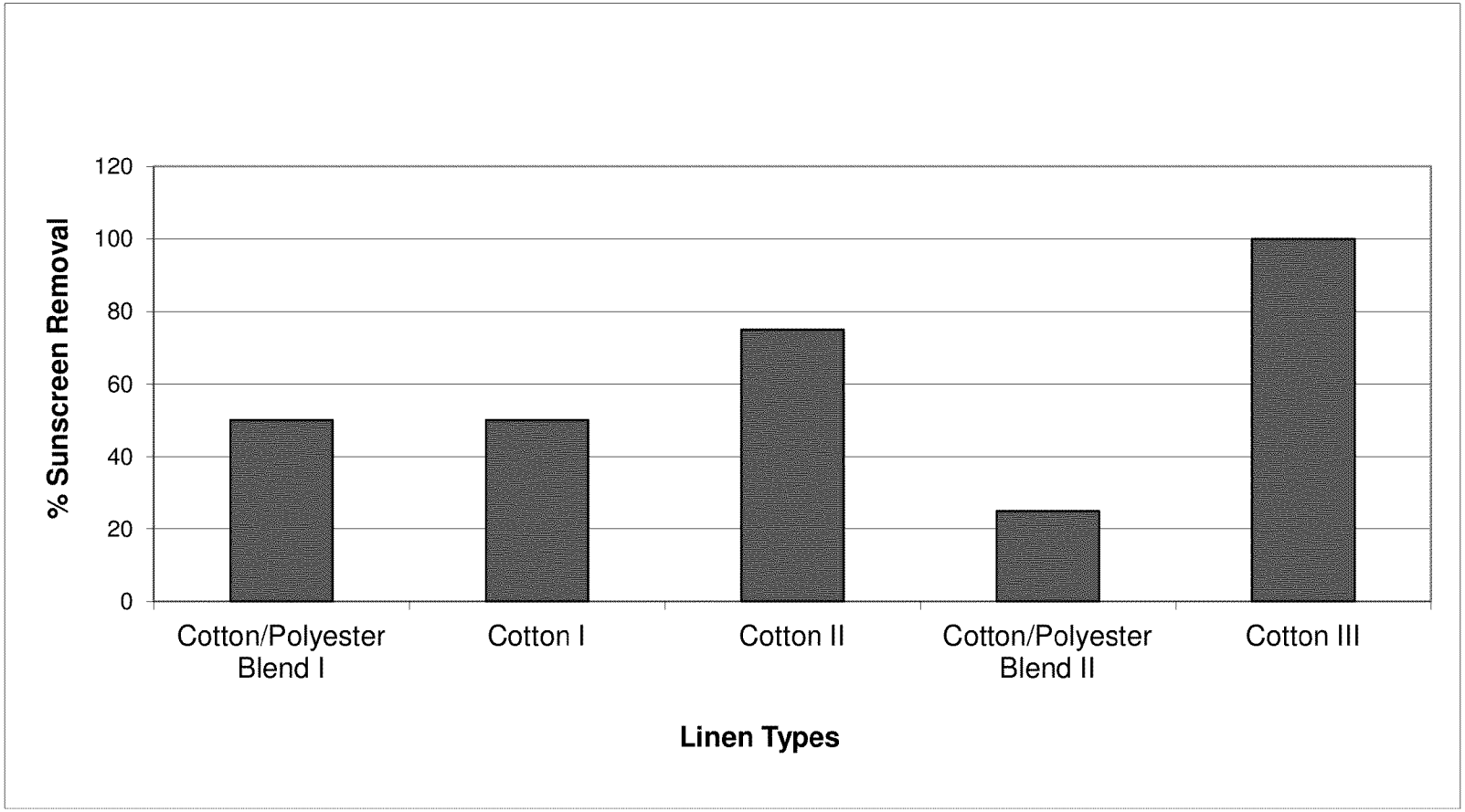
FIG. 6 is a bar graph illustrating the percentage of sunscreen stain removal in the presence of a laurylamine oxide surfactant system with a diethylene glycol ethyl ether solvent system at a 1:1.5 ratio in a sour bath tested with different varying types of linens.

As can be seen in the results illustrated in FIG. 6, the laurylamine oxide/diethylene glycol ethyl ether solution at a 1:1.5 ratio had the greatest sunscreen removal percentage for cotton linens and was not as effective for cotton/polyester blend linens.

TABLE 5

| Operation | Time (min) | Temperature (F.) | Level | Product | Amount |
|---|---|---|---|---|---|
| Sour | 2 | 140 F. | Low | Sour Control (Commercially available by Ecolab Inc., St. Paul, MN) | 6 oz/cwt |
| Suds | 30 | 140 F. | Low | Laurylamine oxide and Diethyl glycol ethyl ether | 97 oz./cwt |
| Rinse | 2 | 90 F. | High | | |
| Rinse | 2 | Split | High | | |
| Rinse | 2 | Split | High | | |
| Extract | 5 | | | | |

Example 7

Removal of Yellow Staining Using Laurylamine Oxide (250 mL)/Diethylene Glycol Ethyl Ether Solution (250 mL) (1:1 Ratio) in a Sour Bath for a Variety of Linens The same experiment as described in Example 6 above was repeated for Example 7 except that a solution of laurylamine oxide (250 mL)/diethylene glycol ethyl ether (250 mL) in a 1:1 ratio was used.

Figure 7:
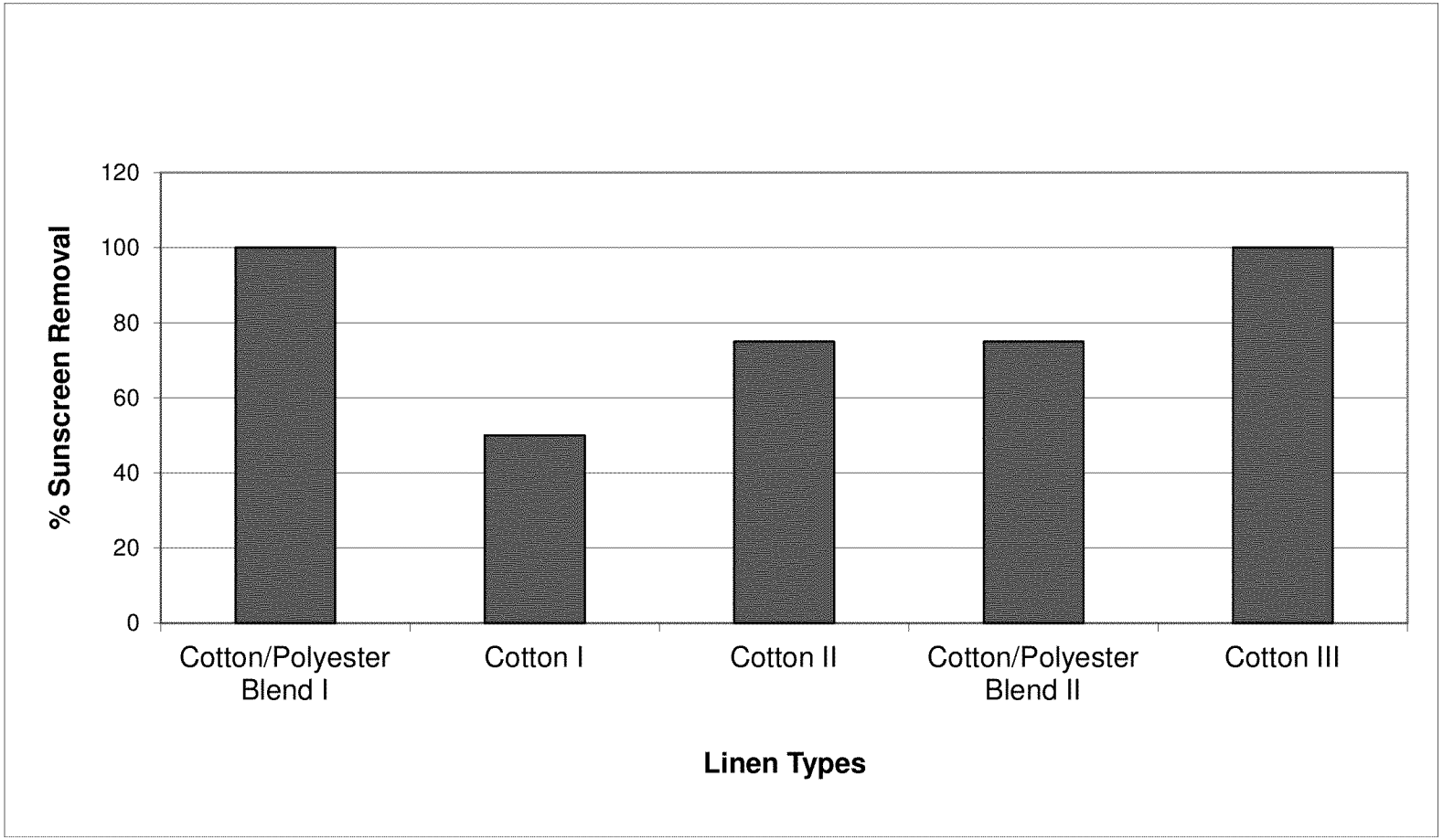
FIG. 7 is a bar graph illustrating the percentage of sunscreen stain removal in the presence of a laurylamine oxide surfactant system (250 mL) with a diethylene glycol ethyl ether solvent system (250 mL) at a 1:1 ratio in a sour bath tested with different varying types of linens.

As can be seen in the results illustrated in FIG. 7, the laurylamine oxide (250 mL)/diethylene glycol ethyl ether (250 mL) solution at a 1:1 ratio had a near equal and average sunscreen removal percentage for cotton linens and cotton/polyester blend linens. However, the effectiveness of the solution was still quite low in removing the yellow stains caused by the sunscreen components.

Example 8

Removal of Yellow Staining Using Laurylamine Oxide (500 mL)/Diethylene Glycol Ethyl Ether Solution (500 mL) (1:1 Ratio) in a Sour Bath for a Variety of Linens The same experiment as described in Example 6 above was repeated for Example 8 except that a solution of laurylamine oxide (500 mL)/diethylene glycol ethyl ether (500 mL) in a 1:1 ratio was used.

Figure 8:
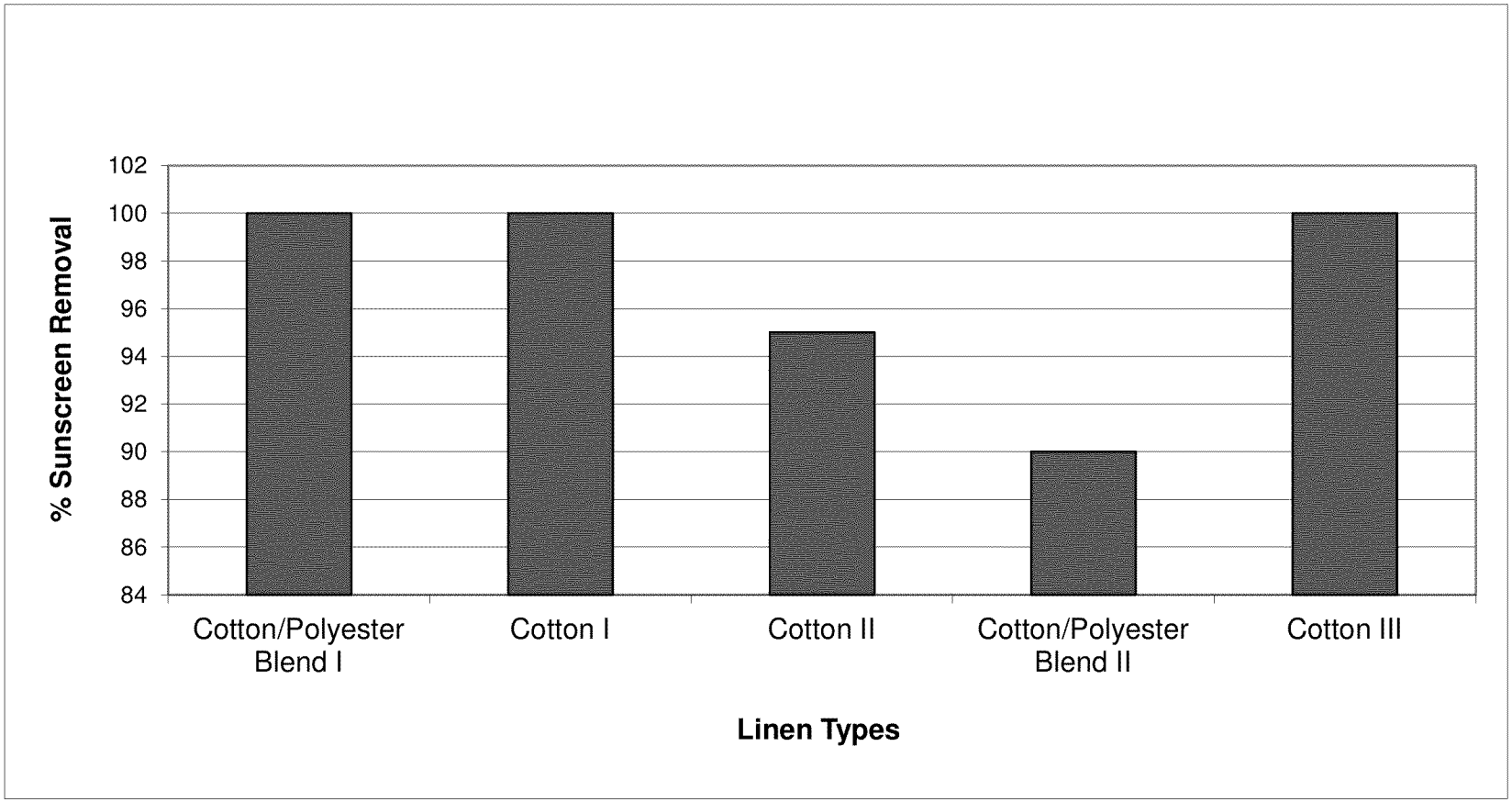
FIG. 8 is a bar graph illustrating the percentage of sunscreen stain removal in the presence of a laurylamine oxide surfactant system (500 mL) with a diethylene glycol ethyl ether solvent system (500 mL) at a 1:1 ratio in a sour bath tested with different varying types of linens.

As can be seen in the results illustrated in FIG. 8, the laurylamine oxide (500 mL)/diethylene glycol ethyl ether (500 mL) solution at a 1:1 ratio had a much greater sunscreen removal percentage for both cotton linens and cotton/polyester blend linens.

Obviously, many modifications and variations of the invention as hereinbefore set forth can be made without departing from the spirit and scope thereof, and, therefore, only such limitations should be imposed as are indicated by the appended claims.

The following is claimed:

1. A cleaning composition for reducing yellow stains caused by sunscreen components which result in sunscreen stains on an fabric, the composition comprising:

a souring agent comprising hexafluorosilicic acid which is present in an amount sufficient to neutralize the fabric;

an amine oxide/organic solvent mixture at a 1:1 to 1:1.5 ratio on a weight basis wherein the organic solvent is selected from the group consisting of glycol ethers, methyl ester of soybean oil fatty acids, and methyl ester of canola oil fatty acids; and water.

2. The cleaning composition of claim 1 wherein the souring agent further comprises phosphoric acid, formic acid, citric acid, gluconic acid, tartaric acid, acetic acid, oxalic acid, methane sulfonic acid, urea sulfate or combinations thereof.

3. The cleaning composition of claim 1 wherein the amine oxide is selected from the group consisting of octyl dimethylamine oxide, decyl dimethyl amine oxide, dodecyl dimethyl amine oxide, hexadecyl dimethyl amine oxide, octadecyl dimethyl amine oxide, lauryl dimethyl amine oxide, isoalkyl dimethyl amine oxide, cetyl dimethyl amine oxide, myristyl dimethyl amine oxide, cocoamidopropyl dimethyl amine oxide, soyamidopropyl dimethyl amine oxide, and combinations thereof.

4. The cleaning composition of claim 1 wherein said composition reduces stains caused by avobenzone, oxybenzone, homosalate, octinoxate, octisalate, octocrylene or combinations thereof.

5. The cleaning composition of claim 1 wherein the composition is added to a wash cycle during a laundry process.

6. The cleaning composition of claim 1 wherein the composition is applied to the fabric prior to the wash cycle during the laundry process.

7. A method for reducing stains caused by sunscreen components from fabric comprising rinsing or washing said fabric with the cleaning composition of claim 1.

8. A method for laundering fabric that is contacted with sunscreen components, the method comprising:

a. providing fabric that has been contacted with a sunscreen component;

b. washing the fabric;

c. rinsing the fabric;

d. drying the fabric; and e. treating the fabric during or prior to or after the fabric is laundered in the washing step with a cleaning composition comprising a souring agent comprising hexafluorosilicic acid which is present in an amount sufficient to neutralize the fabric; an amine oxide/organic solvent mixture at a 1:1 to 1:1.5 ratio on a weight basis, wherein the organic solvent is selected from the group consisting of glycol ethers, methyl ester of soybean oil fatty acids, and methyl ester of canola oil fatty acids; and water.

9. The method of claim 8 wherein the souring agent further comprises phosphoric acid, formic acid, citric acid, gluconic acid, tartaric acid, acetic acid, oxalic acid, methane sulfonic acid, urea sulfate or combinations thereof.

10. The method of claim 8 wherein the amine oxide is selected from the group consisting of octyl dimethylamine oxide, decyl dimethyl amine oxide, dodecyl dimethyl amine oxide, hexadecyl dimethyl amine oxide, octadecyl dimethyl amine oxide, lauryl dimethyl amine oxide, isoalkyl dimethyl amine oxide, cetyl dimethyl amine oxide, myristyl dimethyl amine oxide, cocoamidopropyl dimethyl amine oxide, soyamidopropyl dimethyl amine oxide, and combinations thereof.

11. The method of claim 8 wherein the sunscreen component comprises avobenzone, oxybenzone, homosalate, octinoxate, octisalate, octocrylene or combinations thereof which causes sunscreen stains on the article.

12. A method for reducing yellow stains caused by sunscreen components which result in sunscreen stains on fabric, the method comprising:

a. treating the sunscreen stains with a cleansing composition, wherein the cleaning composition comprises:

i. a souring agent comprising hexafluorosilicic acid which is present in an amount sufficient to neutralize the fabric;

ii. an amine oxide/organic solvent mixture at a 1:1 to 1:1.5 ratio on a weight basis wherein the organic solvent is selected from the group consisting of glycol ethers, methyl ester of soybean oil fatty acids, and methyl ester of canola oil fatty acids; and iii. water.

13. The method of claim 12 wherein the souring agent further comprises phosphoric acid, formic acid, citric acid, gluconic acid, tartaric acid, acetic acid, oxalic acid, methane sulfonic acid, urea sulfate or combinations thereof.

14. The method of claim 12 wherein the amine oxide is selected from the group consisting of octyl dimethylamine oxide, decyl dimethyl amine oxide, dodecyl dimethyl amine oxide, hexadecyl dimethyl amine oxide, octadecyl dimethyl amine oxide, lauryl dimethyl amine oxide, isoalkyl dimethyl amine oxide, cetyl dimethyl amine oxide, myristyl dimethyl amine oxide, cocoamidopropyl dimethyl amine oxide, soyamidopropyl dimethyl amine oxide, and combinations thereof.

15. The method of claim 12 wherein said composition reduces stains caused by avobenzone, oxybenzone, homosalate, octinoxate, octisalate, octocrylene or combinations thereof.

16. The method of claim 12 wherein the composition is added to a wash cycle during a laundry process.

17. The method of claim 16 wherein the composition is applied to the fabric prior to the wash cycle during the laundry process.

* * * * *